US007335837B2

(12) United States Patent
Pfeiler et al.

(10) Patent No.: US 7,335,837 B2
(45) Date of Patent: Feb. 26, 2008

(54) MULTI-LAYER, STRIP-TYPE SCREENING SHEET FOR ELECTRIC LINES AND ELECTRIC CABLE, IN PARTICULAR A DATA TRANSMISSION CABLE, EQUIPPED THEREWITH

(75) Inventors: Christian Pfeiler, Nürnberg (DE); Andreas Wassmuth, Roth (DE); Jörg Weissbrod, Abenberg (DE); Brian George Race, Washington Tyne and Wear (GB)

(73) Assignee: Draka Comteq Germany GmbH & Co. KG, Köln (DE)

( * ) Notice: Subject to any disclaimer, the term of this patent is extended or adjusted under 35 U.S.C. 154(b) by 0 days.

(21) Appl. No.: 11/217,666

(22) Filed: Sep. 2, 2005

(65) Prior Publication Data

US 2006/0048961 A1 Mar. 9, 2006

(30) Foreign Application Priority Data

Feb. 25, 2005 (DE) ..... 10 2004 042 626

(51) Int. Cl.
*H01B 11/06* (2006.01)

(52) U.S. Cl. ..... 174/36; 174/113 R; 174/113 C

(58) Field of Classification Search ..... 174/113 R, 174/113 C, 36
See application file for complete search history.

(56) References Cited

U.S. PATENT DOCUMENTS 2,796,463 A * 6/1957 Mallinckrodt ..... 178/45
3,090,825 A * 5/1963 Volk ..... 174/109
3,312,774 A * 4/1967 Drinko et al. ..... 174/120 SC
4,788,088 A * 11/1988 Kohl ..... 428/34.5
6,624,359 B2 9/2003 Bahlmann et al.
2003/0111241 A1 6/2003 Bahlmann et al.
2003/0217863 A1 11/2003 Clark et al.

FOREIGN PATENT DOCUMENTS

| | | | |
|---|---|---|---|
| DE | 2 419 843 | A | 11/1874 |
| DE | 14 40 919 | A | 1/1969 |
| DE | 93 18 420.4 | A | 3/1994 |
| DE | 198 09 808 | A1 | 10/1998 |
| DE | 0 915 486 | A1 | 5/1999 |
| DE | 199 26 304 | A1 | 12/2000 |
| DE | 102 05 937 | A1 | 8/2002 |
| EP | 0 301 859 | A2 | 2/1989 |
| EP | 0 915 486 | A1 | 5/1999 |

* cited by examiner

*Primary Examiner*—Chau N. Nguyen
(74) *Attorney, Agent, or Firm*—Browdy and Neimark, PLLC

(57) ABSTRACT

A multi-layer, strip-type screening sheet for electric lines comprises at least a substrate layer of plastic material and at least one screening layer of electrically conductive material, in particular metal, which the substrate layer is lined with, the screening layer being provided with spacing gaps that recur at longitudinal intervals for electrical interruption thereof in the longitudinal strip direction.

26 Claims, 8 Drawing Sheets

MULTI-LAYER, STRIP-TYPE SCREENING SHEET FOR ELECTRIC LINES AND ELECTRIC CABLE, IN PARTICULAR A DATA TRANSMISSION CABLE, EQUIPPED THEREWITH

FIELD OF THE INVENTION

The invention relates to a multi-layer, strip-type screening sheet for electric lines, in particular for multi-core data transmission cables, comprising at least one substrate layer of plastic material and at least one screening layer, connected with the substrate layer, of electrically conductive material, in particular of metal. The invention further relates to an electric cable, in particular a data transmission cable, having at least one line, in particular several intertwisted pairs of lines, so-called twisted pairs, in which is used the screening sheet mentioned at the outset.

BACKGROUND OF THE INVENTION

The problems the invention deals with can be explained most obviously in conjunction with high-speed data transmission cables, which does however not restrict the use of the invention to this purpose.

Customary data transmission cables use several of the above twisted pairs, for example four, which must be screened as the category of transmission bandwidth and transmission quality rises. External screening of the twisted pairs as well as screening of the twisted pairs one in relation to the other in a cable are important in this case.

For corresponding specifications of transmission bandwidth and transmission quality to be obtained, U.S. Pat. No. 6,624,359 B2 teaches to provide the twisted pairs with a screening sheet which is comprised of a laminate of a plastic-material substrate layer lined with a screening layer of metal. This document further shows the most varying configurations of how to fold this laminated sheet so that it forms an external screening envelope placed around several twisted pairs and for instance an internal separating and supporting structure of star configuration. Fundamentally, the screening sheet is designed as a strip of material having a continuous screening layer, for example of aluminum or copper, in the longitudinal direction of the strip.

The above design of an electrically conductive screening layer that is continuous in the longitudinal direction of the cable gives rise to problems of grounding because, given varying potentials at the ends of a line, high potential compensation currents can flow through the screening. They cause malfunction and possibly even damages of equipment connected to such a data transmission cable.

SUMMARY OF THE INVENTION

Proceeding from these problems, it is an object of the invention to embody a screening sheet for electric lines and in particular for multi-core data transmission cables in such a way that the sheet keeps its screening properties substantially unimpeded while the above-mentioned problems of grounding are entirely avoided.

This object is attained by the strip-type screening sheet comprising spacing gaps in the screening layer which extend crosswise of the longitudinal direction of the strip, longitudinally recurring at intervals; they serve for electrical interruption of the screening layer in the longitudinal direction of the strip. Consequently, there is no continuous electrically conductive connection in the longitudinal direction of the screening sheet, which completely precludes any flow of potential compensation currents. But with the gaps being small as compared to the rest of the screening surface of the pieces of foil that lie between the spacing gaps, there will be no significant deterioration in the screening behaviour of the screening sheet.

In keeping with a preferred embodiment of the invention, the spacing gaps recur periodically. The ratio that the spacing-gap width bears to the length of the pieces of foil between the spacing gaps preferably ranges between 1:5 and 1:25, with typical lengths of the pieces of foil being in the range of 60 to 120 mm and typical widths of the spacing gaps being in the range of 5 to 10 mm. In practice, the corresponding geometric values must be chosen such that no peaks of impedance or return loss, owing to the periodicity of the structure, will occur in the range of transmission frequency of the data transmission cable.

In keeping with another preferred embodiment of the invention, successive spacing gaps are arranged at a preferably small, acute angle relative to the transverse direction of the strip. Upon alternating angular position, the pieces of foil between the spacing gaps will be trapezoidal. This configuration has the advantage that, with these strips of screening sheet being wound about their longitudinal axis for a tubular envelope to form, the spacing gaps run helically, which, upon interruption of the path of the current in the longitudinal direction, is accompanied with advantages in the screening behaviour as opposed to the gaps that are strictly rectangular in relation of the longitudinal direction of the strip.

With the spacing gaps positioned in parallel at an angle to the transverse direction of the strip, the pieces of foil there-between have the form of a parallelogram. Upon application of the screening sheet in the longitudinal direction of the axis of the cable, this embodiment allows a gap to form that rotates in the way of a helix around the axis of the cable. Upon application of the sheet by a so-called banding system or when the cable is stranded, the acute angle of the spacing gaps relative to the transverse direction of the strip can be designed for compensation by the angle of stranding, resulting in a cylindrical gap free of metal.

An especially solid embodiment with high protection of the susceptible metal screening layer results when the screening layer is placed between, and lined with, two substrate layers. The protective effect is still improved when these substrate layers project over the longitudinal edges of the screening layer, there being united.

The invention also relates to an electric cable and in particular a data transmission cable, with the external envelope and/or an internal supporting and separating structure being comprised of the screening sheet of one of the above mentioned designs. The external envelope, as an overall screen, protects the surroundings against any energies that may radiate from the cable and it protects the transmission elements inside the cable, for example in the form of several twisted pairs, against irradiated interfering energy. In particular this aspect is of special importance in the application of the 10 GB-Ethernet on copper data transmission cables. The external envelope drastically reduces so-called cable crosstalk—also termed Alien-NEXT and Alien-EL-FEXT.

Internal cable crosstalk between the individual twisted pairs is strictly reduced by the screening sheet being integrated into an internal supporting and separating structure, for example by the screening sheet being folded in the way of a four-arm star-configuration profile. Owing to its flexibility, the screening sheet can be applied in virtually any configuration and adapted to the most varying groupings of lines inside the cable. A variety of examples can be seen in U.S. Pat. No. 6,624,359 B2, US 2003/0217863 A1 or EP 0 915 486 A1, without however a screening sheet with a screening layer that is interrupted in the longitudinal direction being employed in any of them.

Further features, details and advantages of the invention will become apparent from the ensuing description of exemplary embodiments, taken in conjunction with the drawings.

DESCRIPTION OF THE PREFERRED EMBODIMENTS

Figure 1:
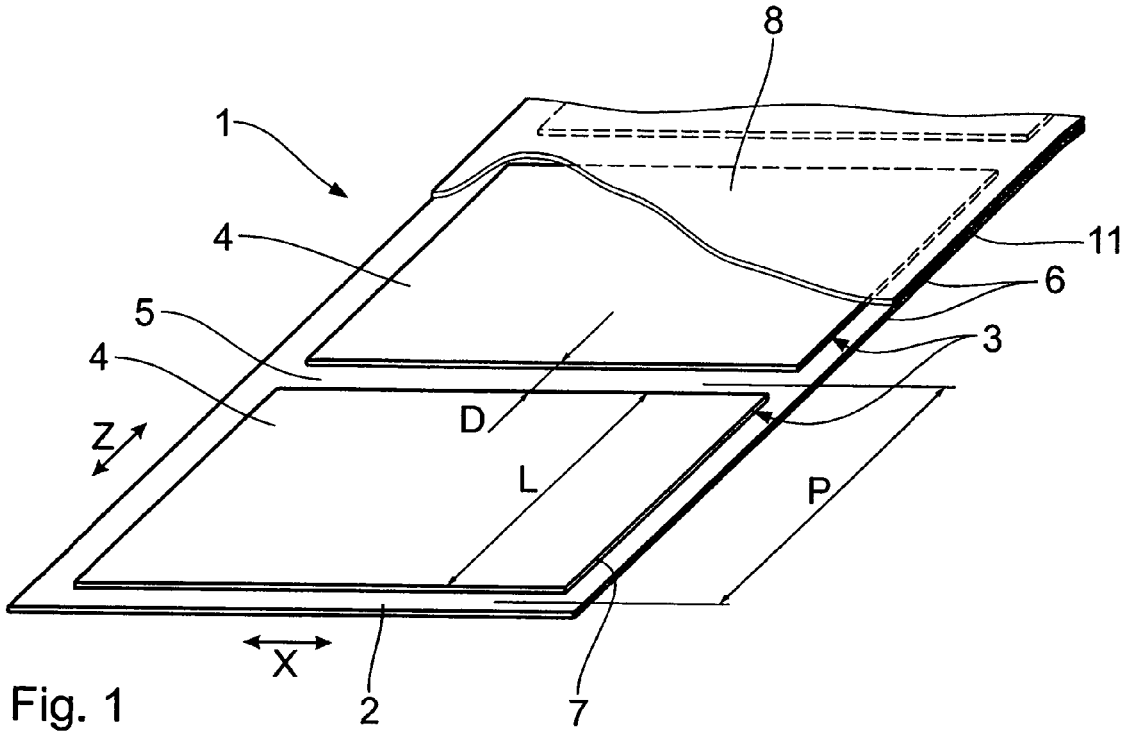
FIG. 1 is a perspective diagrammatic view, partially broken away, of a first embodiment of a multi-layer screening sheet.

FIG. 1 illustrates the basic design of a multi-layer strip-type screening sheet 1. It comprises a first substrate layer 2 of continuous, strip-type plastic material, preferably polyester, of a thickness of 9 to 50 μm. It is lined with a screening layer 3 that consists of individual pieces of metal foil 4 separated from each other by a spacing gap 5. These rectangular pieces of foil have a typical length L of 60 to 120 mm in the longitudinal strip direction Z. The gap width D in the longitudinal strip direction Z typically amounts to approximately 5 to 10 mm so that the ratio that the gap width D bears to the length L of the pieces of foil 4 ranges between 1:5 and 1:25. The width of the pieces of foil 4 is slightly less than that of the substrate layer 2 so that the longitudinal edges 6 of the substrate layer 2 project by some millimeters over the longitudinal edges 7 of the screening layer 3. The metal foil of the screening layer 3 preferably consists of aluminum of a layer thickness between 5 and 50 μm.

The screening layer 3 is lined with another substrate layer 8 so that a kind of sandwich sheeting is produced. The substrate layer 8 consists of the same material as the substrate layer 2 and is tightly united with the bottom substrate layer 2 in the vicinity of the longitudinal edges that project laterally over the screening layer 3. Thus the screening layer 3 is hermetically insulated outwards.

Durably uniting the three layers 2, 3, 8 takes place by suitable adhesives customary in the field of laminated sheeting. For reasons of manufacture and stability, the substrate layer 2 can be comprised of several layers of uniform material.

FIG. 1 does not show in detail that, in lieu of the laterally projecting longitudinal edges, the longitudinal edge 6 of the top substrate layer 8 may be flush with the longitudinal edge of the pieces of metal foil 4 so that, when the screening sheet 1 is wound around corresponding lines (which is going to be explained in detail, taken in conjunction with FIGS. 6 to 9), the lapping longitudinal edges of the screening sheet 1 are not bulky in the area of overlap.

In keeping with another embodiment of a screening sheet 1" seen in FIGS. 5 to 9, the longitudinal edges 6 of the substrate layers 2, 8 and the longitudinal edges 7 of the screening layer 3 may also be flush, leaving the longitudinal edge 7 of the screening layer 3 accessible and perceptible from outside.

Figure 2:
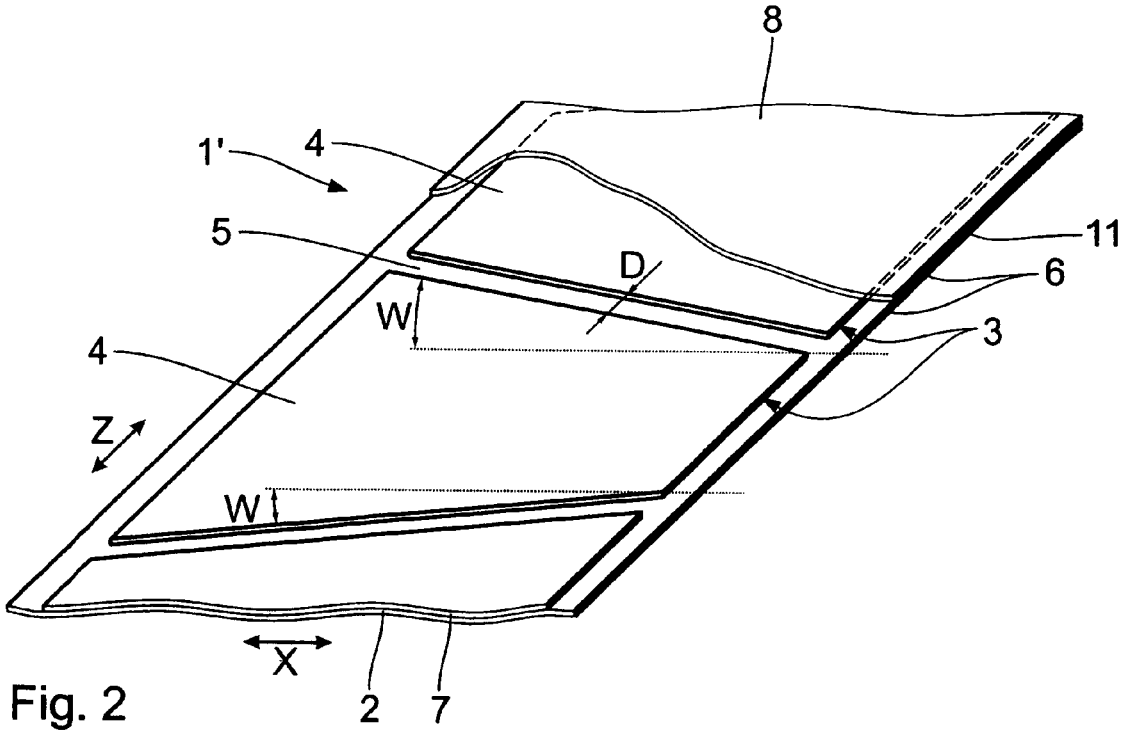
FIGS. 2 and 3 are analogous views of a second and third embodiment of a screening sheet.

The embodiment of the screening sheet 1' seen in FIG. 2 differs from that of FIG. 1 only in the way of how the spacing gaps 5 extend. They are not arranged strictly at right angles to the longitudinal direction Z of the strip, but at a small acute angle W to the transverse direction X of the strip. The directions of this slant are opposite from one spacing gap 5 to another so that the pieces of foil 4 between two adjacent spacing gaps 5 are trapezoidal in a plan view.

Figure 3:
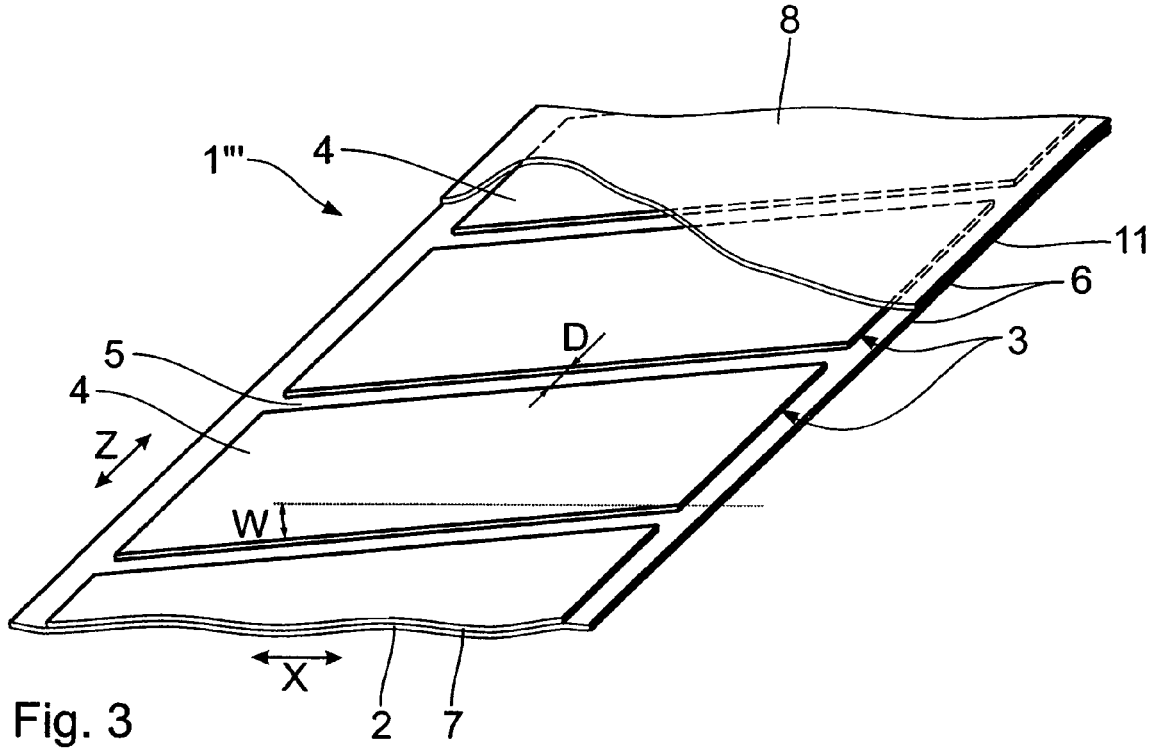

In keeping with another embodiment according to FIG. 3, these spacing gaps are disposed at a small acute angle W to the transverse direction X of the strip, but parallel to each other in this screening sheet 1'". Thus the pieces of foil 4 between two adjacent spacing gaps 5 are designed in the form of a parallelogram in a plan view.

As regards any further details of the embodiments according to FIGS. 2 and 3, reference is made to the description of FIG. 1 where identical component parts have the same reference numerals.

Figure 4:
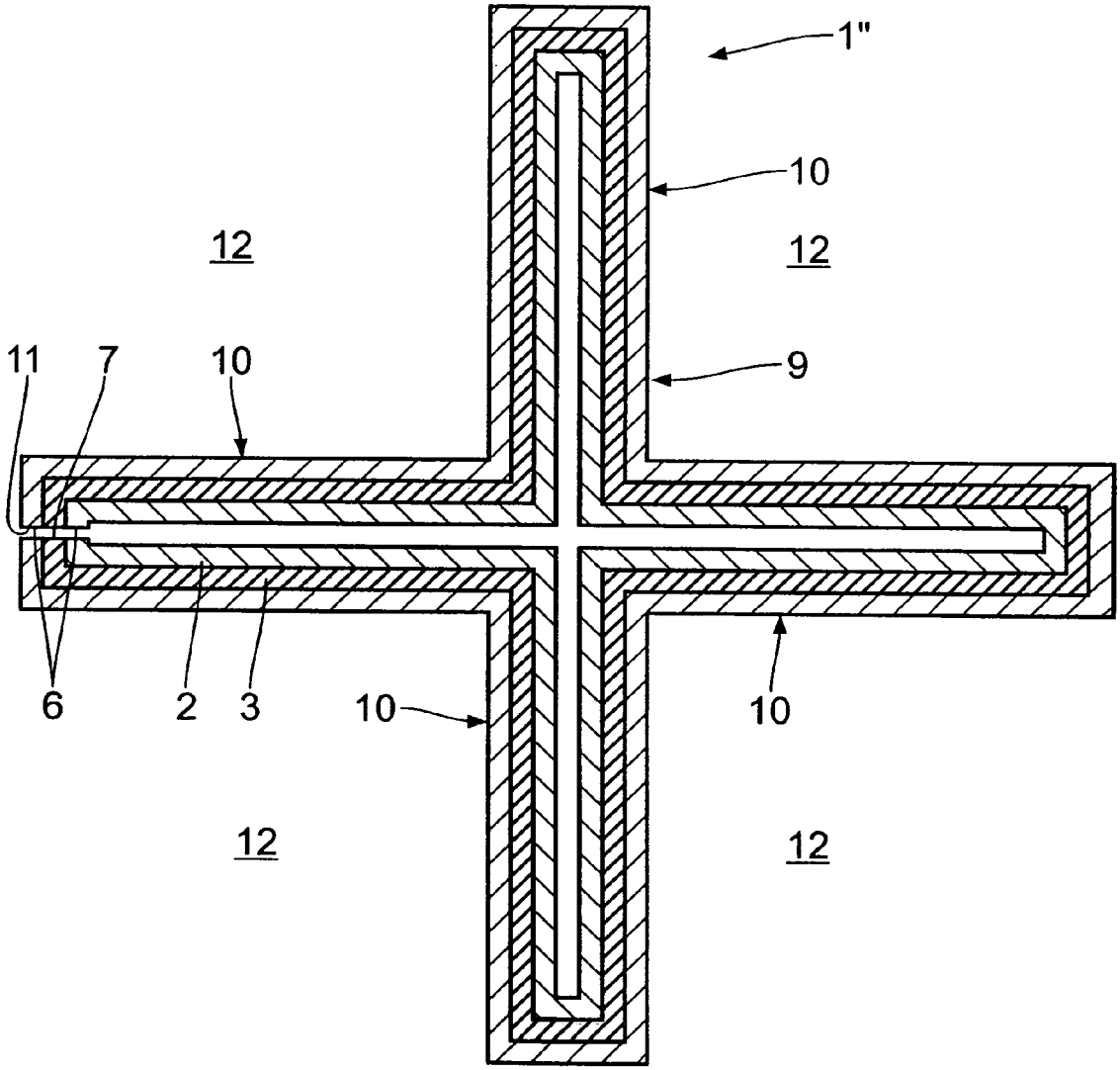
FIGS. 4 and 5 are strongly diagrammatic illustrations of a cross-sectional and a perspective view of an internal supporting and separating structure to be used in a data transmission cable.
Figure 5:
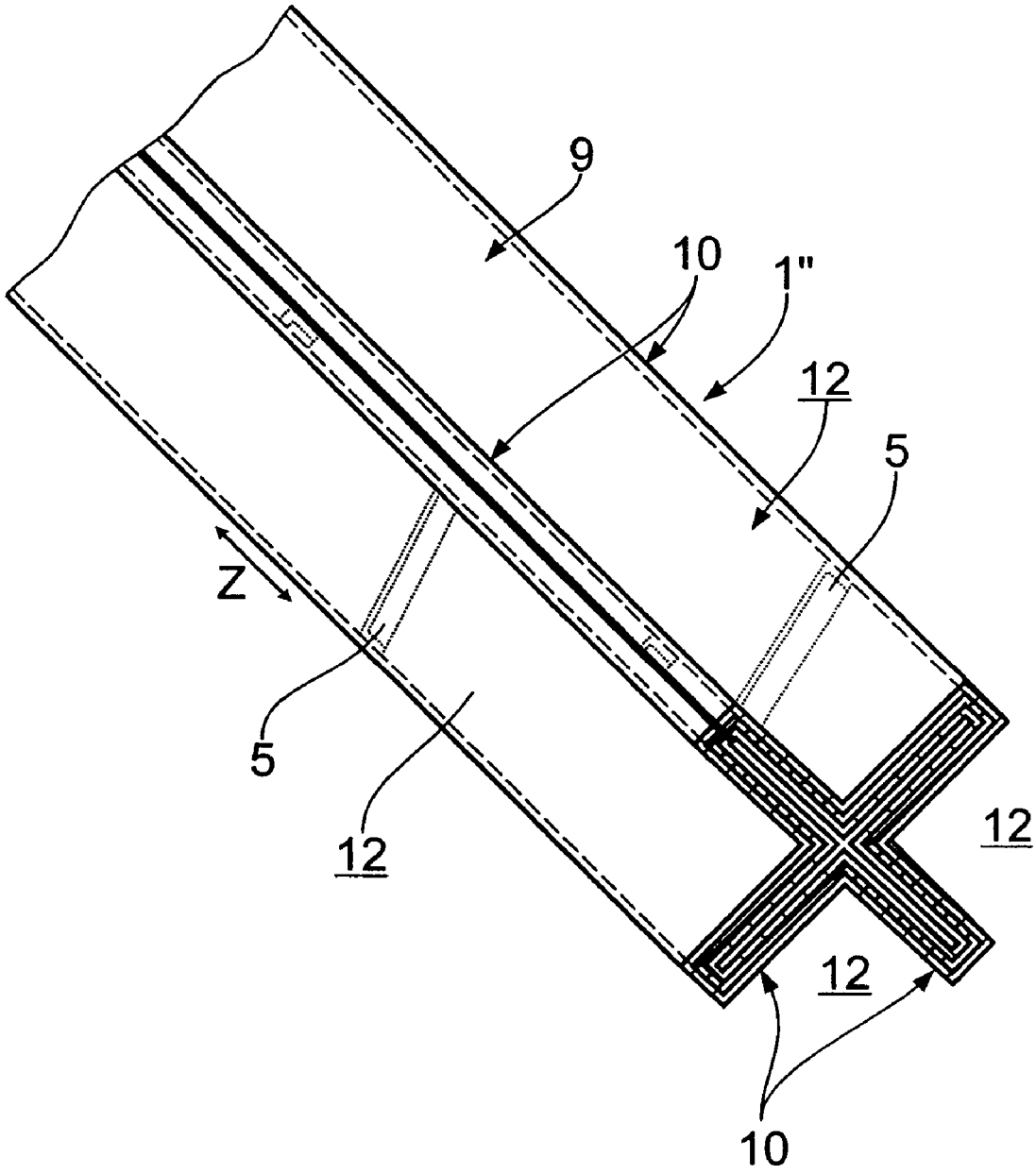

The screening sheets 1, 1', 1", 1'" described above can be used in the most varying configurations in electric cables and in particular in high-speed data transmission cables 15. FIGS. 4 and 5 show an internal supporting and separating structure 9—a so-called spline—with the screening sheet 1' being folded down on itself in the longitudinal strip direction Z in such a way that four separating ribs 10 of star configuration are produced. To this end, the inside substrate layer 2 can be fixed by suitable adhesives in the areas that flank each other. The joint between the two longitudinal edges 11 of the screening sheet 1' can be seen at the left separating rib 10. As mentioned above, the screening layer 3 ends openly in the longitudinal edge 11.

Figure 6:
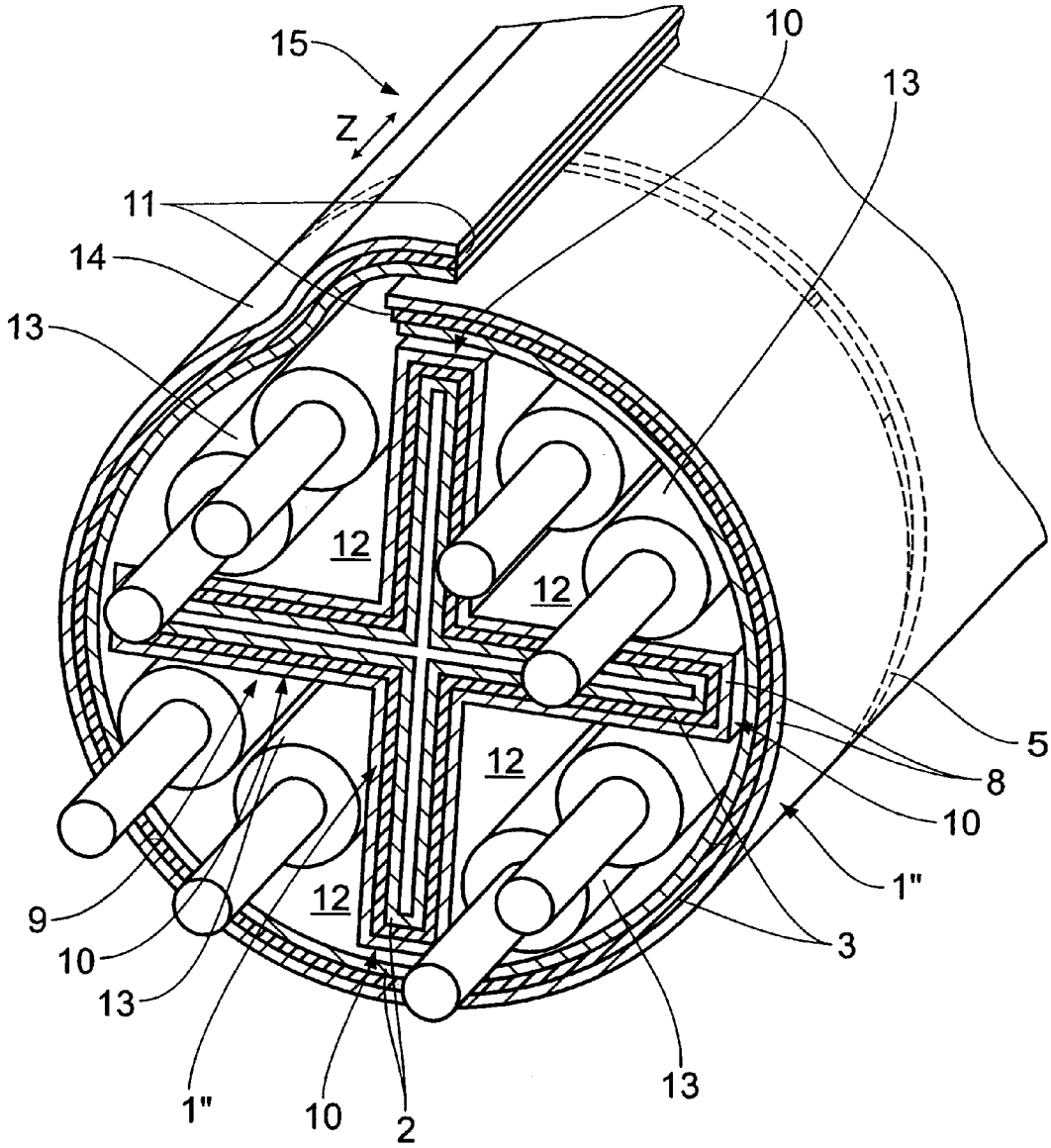
FIG. 6 is a strongly diagrammatic perspective view of a first embodiment of a data transmission cable.

As seen in FIG. 6, twisted-pair lines 13 are accommodated in each of the quadrantal zones 12 between the separating ribs 10, thus screened from each other by the screening layer 3 inside the separating ribs 10. The entire array of the internal supporting and separating structure 9 and the four twisted-pair lines 13 are insulated by an external envelope 14 which again consists of a screening sheet 1". This strip-type screening sheet is folded down, forming a hose, and, for example, welded in the vicinity of its lapping longitudinal edges 11. Thus the total line arrangement 15 is completely screened to the outside.

FIGS. 5 and 6 roughly outline the slant of the spacing gaps 5. Noticeably, the ends of the spacing gaps 5 are displaced one in relation to the other in the longitudinal direction Z of the strip. The helical extension of the spacing gaps 5 precludes any electromagnetic-irradiation level from being continuous throughout the cross-sectional area of the cable.

Figure 7:
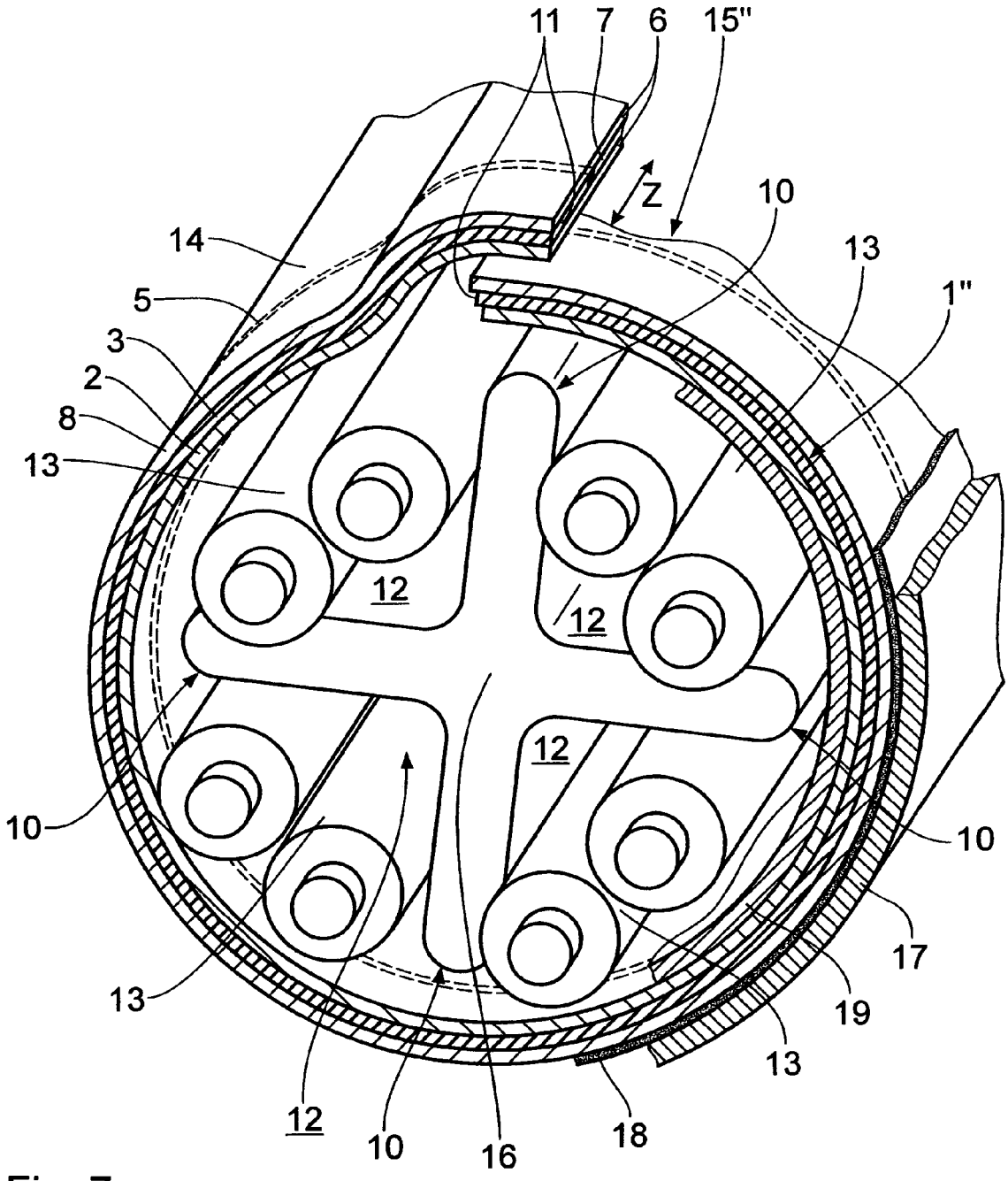
FIG. 7 is an illustration, by analogy to FIG. 6, of a second embodiment of a data transmission cable.

In the embodiment seen in FIG. 7, the data transmission cable 15', by analogy to the embodiment of FIG. 6, is again equipped with the externally screened envelope 14, but the internal supporting and separating structure is a customary cruciform section 16 extruded from insulating plastic material. Standing in for the embodiments of FIGS. 6, 8 and 9, FIG. 7 further shows details of an external protecting jacket 17 of polymeric insulating material that insulates the data transmission cable 15" mechanically outwards. To this end, the protecting jacket 17 envelops the screening sheet 1", which is applied—as illustrated—in the form of a hose of longitudinal extension or helically wound structure, and, as the case may be, is tightly united there-with by way of an optional adhesive layer 18. In this case, stripping the insulation and baring the lines 13, upon installation of the cable 15', are facilitated as the screening sheet 1" is being stripped at the same time the external protecting jacket 17 is being removed.

In keeping with another variation of design, provision may be made for an internal protecting jacket 19 which is applied to the basic cable element comprised of the cruciform section 16 and the four pairs of twisted-pair lines 13, to which is applied the screening sheet 1" in longitudinal extension of wound structure and completed by the protecting jacket 17 with the adhesive layer 18.

Figure 8:
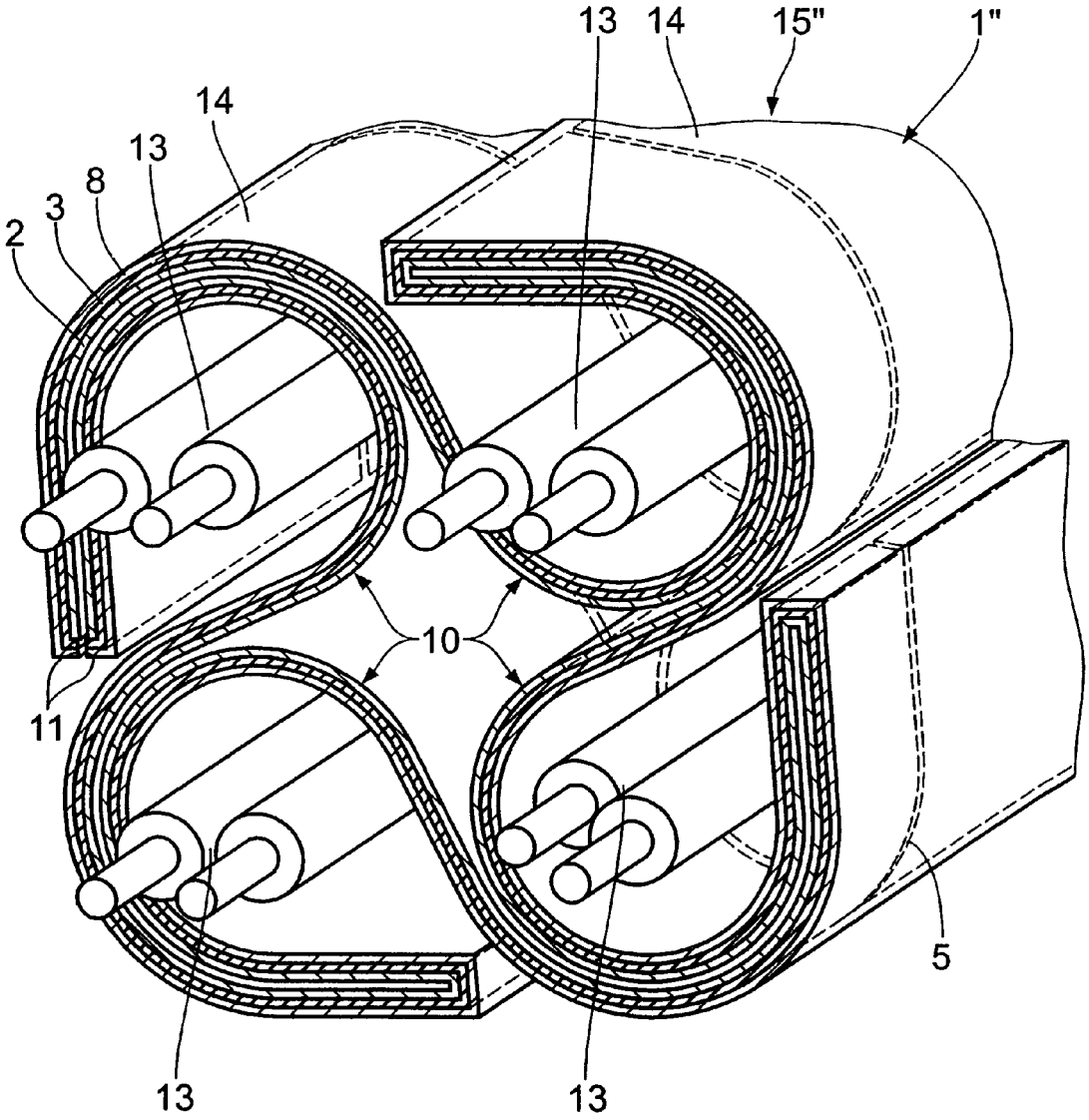
FIGS. 8 and 9 are strongly diagrammatic, perspective views of data transmission cables with integrated screening sheets that are partially folded down on themselves.

In the embodiment of a data transmission cable 15" seen in FIG. 8, a very wide screening sheet 1" is sectionally folded down on itself appropriately for the four twisted-pair lines 13 being enveloped by the screening sheet 1" inwardly and outwardly. This meandering envelope of "ornamental" cross-sectional shape of the twisted-pair lines serves for screening to the outside as well as between the lines 13. An external mechanical protecting sleeve has been omitted in FIG. 8—as well as in FIG. 9—for reason of clarity.

Figure 9:
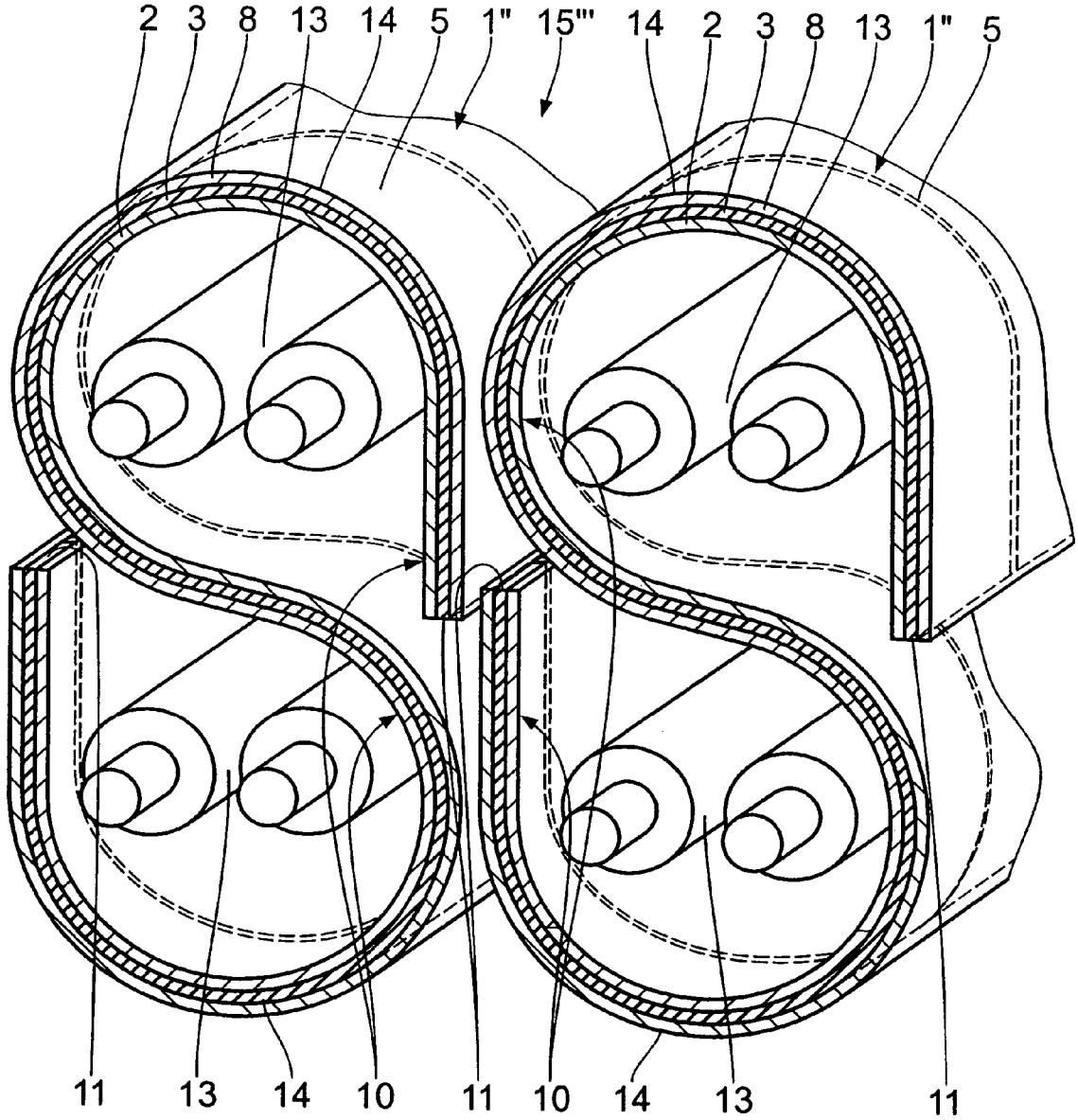

In FIG. 9 as mentioned, two screening sheets 1" are placed in the shape of an S around two adjacent twisted-pair lines 13, here too ensuring external and internal screening of the lines 13.

What is claimed is:

1. A multi-layer, strip-type screening sheet for electric lines, comprising at least one substrate layer (2, 8) of a plastic material; and at least one screening layer (3) of an electrically conductive material which the substrate layer (2, 8) is lined with;

the screening layer (3) having a layer thickness between 5 and 50 μm and being provided with spacing gaps (5) that interrupt electrical conduction therein in a longitudinal strip direction (Z), with the spacing gaps (5) extending crosswise of the longitudinal strip direction (Z) and recurring at longitudinal intervals (p), wherein the screening layer (3) is made of a metal foil which is separated into foil pieces (4) by said spacing gaps (5) and wherein a ratio that a spacing-gap width (D) bears to a length (L) of said foil pieces (4) remaining between said spacing gaps (5) ranges between 1:5 and 1:25.

2. A screening sheet according claim 1, wherein the spacing gaps (5) recur at periodical intervals.

3. A screening sheet according to claim 1, wherein the spacing gaps (5) extend at an acute angle (W) in relation to a transverse strip direction (X).

4. A screening sheet according to claim 3, wherein two successive spacing gaps (5) extend in opposite angular directions in relation to the transverse strip direction (X) such that the foil pieces (4) that remain there-between have a shape of a trapezoid.

5. A screening sheet according to claim 3, wherein two successive spacing gaps (5) extend in parallel angular directions in relation to the transverse strip direction (X) such that the foil pieces (4) that remain there-between have a shape of a parallelogram.

6. An electric cable (15, 15', 15"), comprising at least one line (13), comprising an external envelope (14) comprised of said screening sheet (1, 1', 1", 1''') according to claim 1.

7. An electric cable according to claim 6, wherein the external envelope (14) is enclosed by a protecting jacket (17).

8. An electric cable according to claim 6, wherein an adhesive layer (18) is disposed between the envelope (14) and the protecting jacket (17).

9. An electric cable according to claim 6 , wherein a protecting jacket (19) is disposed between the at least one line (13) and the external envelope (14).

10. An electric cable (15, 15', 15"), comprising at least one line (13), comprising an internal supporting and separating structure (9) comprised of said screening sheet (1, 1', 1", 1''') according to claim 1.

11. An electric cable according to claim 10, wherein the internal supporting and separating structure (9) is comprised of said screening sheet (1, 1', 1", 1''') that is at least sectionally folded down on itself in a longitudinal direction.

12. A screening sheet according to claim 1, comprising at least two substrate layers (2, 8), wherein one screening layer (3) is placed between, and lined with, two of said substrate layers (2, 8).

13. A screening sheet according to claim 12, wherein the two substrate layers (2, 8) comprise longitudinal edges (6) which project over longitudinal edges (7) of the screening layer (3).

14. A multi-layer, strip-type screening sheet for electric lines, comprising at least two substrate layers (2, 8) of a plastic material; and at least one screening layer (3) of an electrically conductive material which is placed between, and lined with, two of said substrate layers (2, 8);

the screening layer (3) having a layer thickness between 5 and 50 μm and being provided with spacing gaps (5) that interrupt electrical conduction therein in a longitudinal strip direction (Z), with the spacing gaps (5) extending crosswise of the longitudinal strip direction (Z) and recurring at longitudinal intervals (p).

15. A screening sheet according to claim 14, wherein the spacing gaps (5) recur at periodical intervals.

16. A screening sheet according to claim 14, wherein the spacing gaps (5) extend at an acute angle (W) in relation to a transverse strip direction (X).

17. A screening sheet according to claim 14, wherein two successive spacing gaps (5) extend in opposite angular directions in relation to the transverse strip direction (X) such that the foil pieces (4) that remain there-between have a shape of a trapezoid.

18. A screening sheet according to claim 14, wherein two successive spacing gaps (5) extend in parallel angular directions in relation to the transverse strip direction (X) such that the foil pieces (4) that remain there-between have a shape of a parallelogram.

19. A screening sheet according to claim 14, wherein the screening layer (3) is made of a metal foil which is separated into foil pieces (4) by said spacing gaps (5) and wherein a ratio that a spacing-gap width (D) bears to a length (L) of said foil pieces (4) remaining between said spacing gaps (5) ranges between 1:5 and 1:25.

20. A screening sheet according to claim 14, wherein the two substrate layers (2, 8) comprise longitudinal edges (6) which project over longitudinal edges (7) of the screening layer (3).

21. An electric cable (15, 15', 15") comprising at least one line (13), comprising an external envelope (14) comprised of said screening sheet (1, 1', 1", 1''') according to claim 14.

22. An electric cable according to claim 21, wherein the external envelope (14) is enclosed by a protecting jacket (17).

23. An electric cable according to claim 21, wherein an adhesive layer (18) is disposed between the envelope (14) and the protecting jacket (17).

24. An electric cable according to claim 21, wherein a protecting jacket (19) is disposed between the at least one line (13) and the external envelope (14).

25. An electric cable (15, 15', 15"), comprising at least one line (13), comprising an internal supporting and separating structure (9) comprised of said screening sheet (1, 1', 1", 1''') according to claim 14.

26. An electric cable according to claim 25, wherein the internal supporting and separating structure (9) is comprised of said screening sheet (1, 1', 1", 1''') that is at least sectionally folded down on itself in a longitudinal direction.

* * * * *